United States Patent [19]

Gelsing et al.

[11] 4,208,179

[45] Jun. 17, 1980

[54] INTERNALLY COOLED WORKPIECE-SUPPORT GRATE

[75] Inventors: Winfried Gelsing, Essen; Hans-Martin Nolzen, Voerde-Spellen, both of Fed. Rep. of Germany

[73] Assignee: Oschatz GmbH, Essen, Fed. Rep. of Germany

[21] Appl. No.: 27,866

[22] Filed: Apr. 6, 1979

[30] Foreign Application Priority Data

Apr. 8, 1978 [DE] Fed. Rep. of Germany .....: 2815260

[51] Int. Cl.[2] ..... F26D 3/12

[52] U.S. Cl. ..... 432/234; 165/142; 137/599

[58] Field of Search ..... 432/234, 235, 233, 173; 137/599; 138/39; 165/142; 198/599

[56] References Cited

U.S. PATENT DOCUMENTS 3,183,930 5/1965 Barr ..... 138/39

3,471,134 10/1969 Cone ..... 432/234

FOREIGN PATENT DOCUMENTS 2615431 11/1977 Fed. Rep. of Germany .

2643235 3/1978 Fed. Rep. of Germany ..... 432/234

*Primary Examiner*—Henry C. Yuen

*Attorney, Agent, or Firm*—Karl F. Ross

[57] ABSTRACT

A furnace workpiece-support system has at least one horizontal workpiece-support tube through which a fluid coolant is circulated and which is supported on at least one vertical tube that is connected at its upper end to this horizontal tube and that has a blind lower end. A flow-diversion pipe has an upper intake end opening in an upstream direction into the horizontal tube and a lower end opening downwardly into the vertical tube. This pipe is received with clearance in the vertical tube so that coolant diverted by the pipe from the horizontal tube is injected downwardly into the vertical pipe to cool it and then rises vertically in the vertical tube around the pipe to reenter the horizontal tube after cooling the vertical tube. A deflection plate is mounted in the horizontal tube and generally blocks at least the lower part of the flow cross section thereof at a location downstream of the intake end of the pipe, but upstream of the upper end of the vertical tube so that fluid rising in the vertical tube can rejoin the fluid stream in the horizontal tube without turbulence.

10 Claims, 8 Drawing Figures

INTERNALLY COOLED WORKPIECE-SUPPORT GRATE

FIELD OF THE INVENTION

The present invention relates to an internally cooled workpiece-support grate. More particularly this invention concerns such a grate or support system used in an industrial pusher-type or tunnel-type furnace.

BACKGROUND OF THE INVENTION

It is known, as for example from U.S. Pat. No. 3,471,134 or German Pat. Publication No. 2,615,431, to support a workpiece in a furnace on internally cooled support tubes. Two sets of such tubes are frequently provided to form a walking-beam conveyor.

In order to prevent the supports from heating excessively, they are formed entirely as tubes through which a fluid coolant such as air or steam is circulated. Normally this circulation takes place from one end to the other of the horizontal tubes of such a support system. Since considerable thermal expansion takes place in these arrangements it is normally necessary to support these horizontal tubes between their ends by means of vertical tubes whose lower ends are supported on carriages or the like that allow them to travel limitedly in the longitudinal direction of the horizontal tubes.

To cool these vertical support tubes as well as the horizontal tubes, a small-diameter diversion pipe is provided at the joint between the upper end of each of the vertical tubes and the respective horizontal tube. Such a diversion pipe has an upper leg opening in the upstream direction, that is against the direction of flow through the horizontal tube, and a lower leg opening downwardly into the center of the respective tube. This lower leg is received with all-around clearance in the vertical tube. Thus some of the fluid moving along the horizontal tube will enter the intake end of the diversion tube and will be injected from the output end thereof into the vertical tube. This diverted coolant will cool the vertical tube and then rise in the annular space around the diversion pipe to rejoin the stream flowing along the horizontal tube. Such an arrangement ensures that even the vertical support legs for the horizontal tubes will be sufficiently cooled to prevent their weakening.

A disadvantage of this type of arrangement is that considerable turbulence is created at the joint where the upper end of each of the vertical tubes is connected to the respective horizontal tube. This turbulence, caused at least in part by the coolant stream rising out of the vertical tube, reduces overall flow through the system and, therefore, reduces cooling efficiency therein.

OBJECTS OF THE INVENTION

It is therefore an object of the present invention to provide an improved cooled support system for a furnace.

Another object is to provide a workpiece-support system which overcomes the above-given disadvantages.

SUMMARY OF THE INVENTION

These objects are attained according to the instant invention in a furnace workpiece-support system of the above-described general type and having a deflection plate in the horizontal tube generally blocking at least the lower part of the flow cross section thereof. The intake end of the flow-diversion pipe opens generally at this plate. Thus flow through the horizontal tube will be diverted up and over the upper end of each of the vertical tubes, with most of the flow from the lower portion of the horizontal tube being diverted down into the vertical tube and then returning to it at this lower portion but at a location downstream of the plate. Thus turbulence is minimized so that relatively efficient coolant flow through the horizontal tube and, indeed, through the entire system is possible.

According to further features of this invention the deflection plate is planar and of semicircular shape, extending upwardly to a location at least one-third of the way upwardly from the bottom of the horizontal tube. This plate is inclined downwardly into the flow direction, that is its lower semicircular edge is upstream of its upper diametrical or straight edge. In this case the diversion tube can be straight and open directly at the inclined plane defined by the upper upstream face of this plate. The curved downstream edge may be spaced slightly from the adjacent walls of the horizontal tube, forming a narrow gap therewith, and the upper edge may be bent down in the direction parallel to the flow direction to further minimize turbulence.

It is also possible according to this invention to form the diversion tube of L-shape, with a horizontal upper leg joined to a vertical lower leg by means of an elbow. The entire upper leg may be formed as a backward pitot body, that is with relatively large upstream mouth and a relatively small downstream mouth, the former opening upstream of the deflection plate and the latter downstream thereof. Thus the downstream end in effect forms a jet pump creating a good vacuum to draw the coolant out of the vertical tube.

In accordance with yet another feature of this invention an L-shaped diversion tube is provided at its upper end with a deflection plate which extends downwardly away from the flow direction through the horizontal tube. The intake mouth of the diversion tube opens at the upstream edge of the plate, whence the plate arcs up and then downwardly. Just behind and beneath its highest point the plate is formed with throughgoing holes to further aid circulation to reduce turbulence.

SPECIFIC DESCRIPTION

Figure 1:
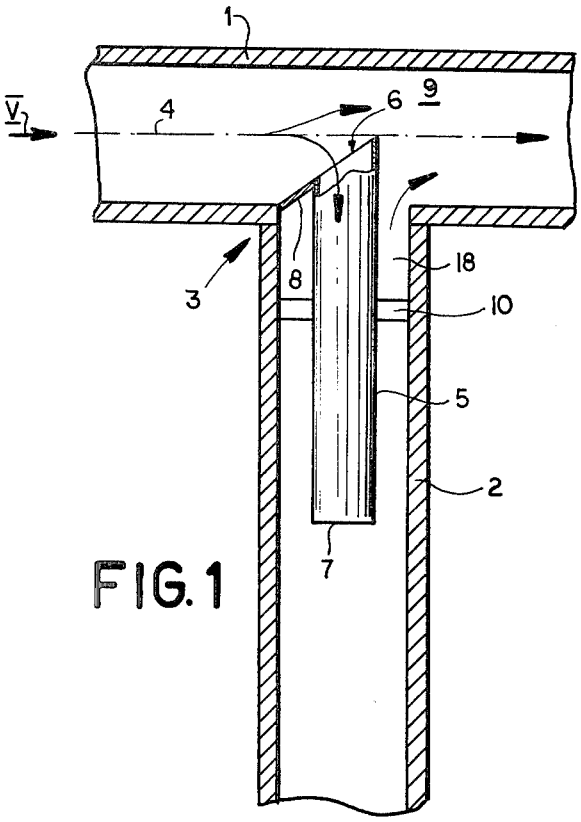
FIGS. 1, 2, 3, and 4 are vertical sections through portions of workpiece-support systems according to this invention.
Figure 5:
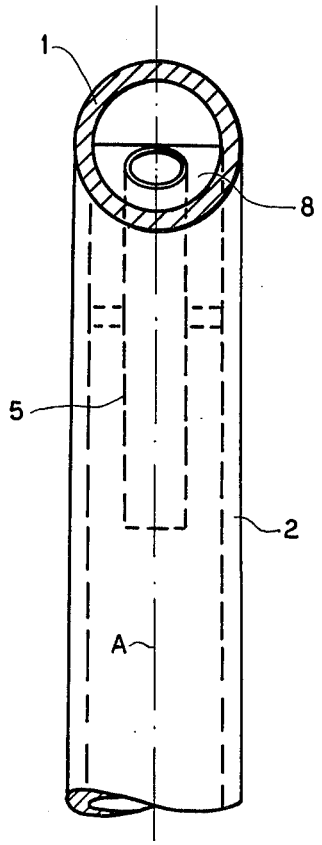
FIGS. 5, 6, 7, and 8 are views taken in the direction of respective arrows V, VI, VII, and VIII of FIGS. 1, 2, 3, and 4.
Figure 8:
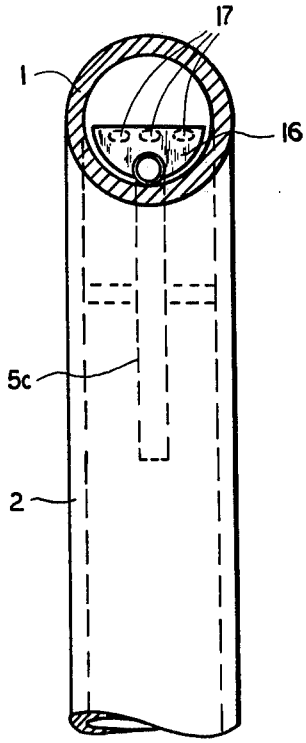

The system according to the instant invention as shown in FIGS. 1 and 5 has a horizontal tube 1 supported on a vertical tube 2 at a joint 3 and corresponding generally to that portion of a workpiece-support system such as shown in FIG. 8 of above-cited U.S. Pat. No. 3,471,134 of CONE, the entire disclosure of which is herewith incorporated by reference. A fluid coolant, normally steam, is circulated equally through the horizontal tube 1 in the flow direction indicated at arrow 4. A diversion pipe 5 has an upper end 6 opening in the tube 1 and a lower end 7 opening downwardly into the tube 2. This diversion pipe 5 is supported via radial struts 10 in the tube 2 with all-around clearance, forming an annular outflow space 18 therewith.

According to this invention the diversion pipe 5 is provided at its upper end with a semicircular planar deflection plate 8 having a semicircular lower edge welded to the inner wall of the tube 1 and a straight upper edge lying exactly on a diameter of this tube 1. The plate 8 lies at an angle of between 45° and 15°, here 30°, to the direction 4.

With this system steam flowing along in the direction 4 will be diverted partially upwardly into the open region 9 above the plate 8, and partially down into the pipe 5 which will inject it into the tube 2. This coolant injected into the tube 2 will cool this tube 2 and will then rise countercurrent in the space 18 to rejoin the coolant flowing along the tube 1. As the flow through the tube 1 is deflected upwardly into the space 9, the coolant flowing back up around the injector pipe 5 will be able to rejoin the stream in this tube 1 without turbulence.

Figure 2:
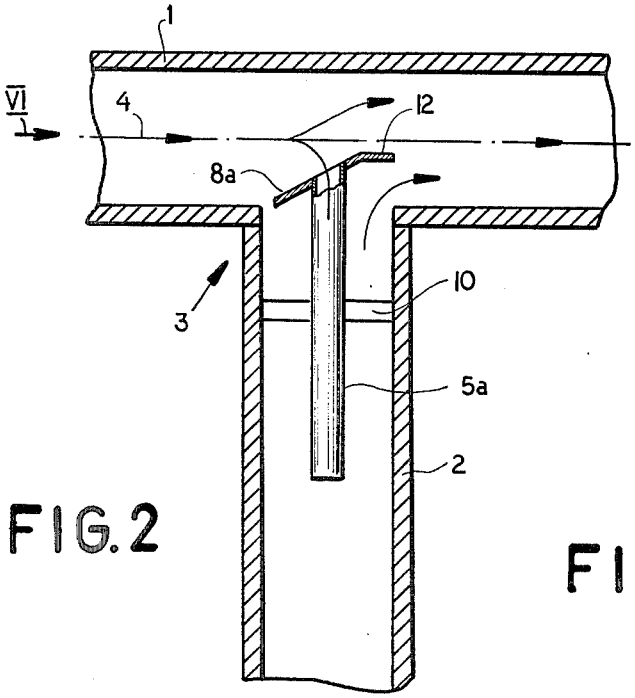
Figure 6:
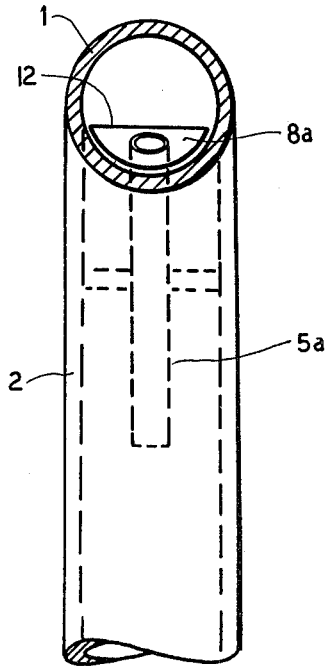

FIGS. 2 and 6 show a system substantially identical to that of FIGS. 1 and 5, and using identical reference numerals for identical structure. Here a straight small-diameter tube 5*a* is employed which carries at its upper end a relatively small semicircular plate 8*a* defining a semicircular gap 11 with an axial projection of the inner wall of the tube 1 at the joint 3. In In addition the upper end of this plate 8*a* is bent down at 12 exactly paralled to the flow direction 4 so as further to reduce turbulence. The principal reason for making the plate 8*a* somewhat smaller than the plate 8 is that it is possible to mount the pipe 5*a* with the plate 8*a* on the upper end of the tube 2 before joining of the tube 2 to the tube 1. This system functions substantially the same as the system of FIGS. 1 and 5.

Figure 3:
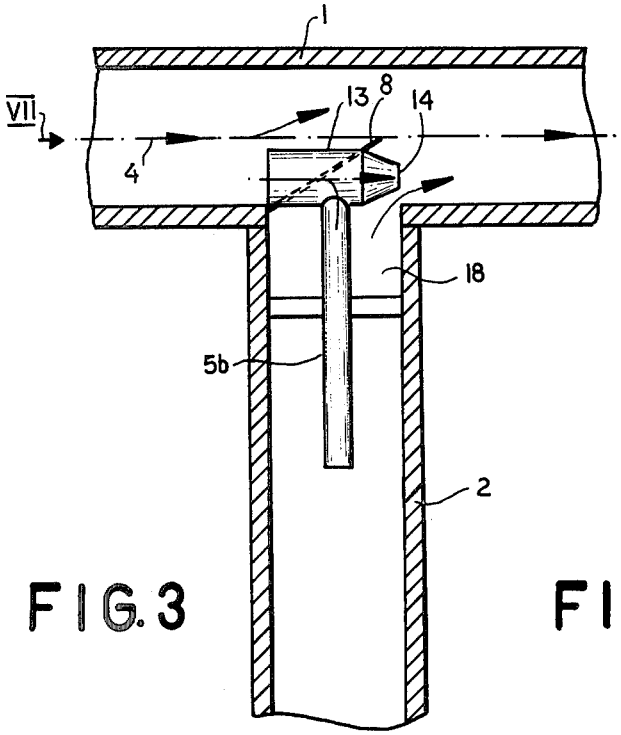
Figure 7:
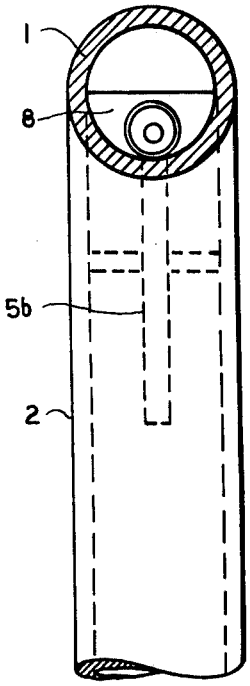

In FIGS. 3 and 7 the same reference numerals as in FIGS. 1 and 5 are again used for functionally identical structure. Here a small-diameter diversion tube 5*b* has an upper horizontal leg 13 of considerably larger diameter which extends through a plate 8 identical to the plate of FIG. 1. In addition this upper leg 13 of the pipe 5*b* is tapered to form a small-diameter outlet mouth or nozzle 14 opening behind the plate 8 in the direction 4. Thus the relatively large amount of coolant trapped by the large-diameter mouth of the intake or upstream end of the pipe 5*b* is in part diverted downwardly into the pipe 5*b* to cool the tube 2, and in part directed backwardly to be injected into the tube 1 behind the plate 8 at the nozzle 14. This nozzle 14 therefore entrains fluid rising in the space 18 jet-pump fashion to reduce turbulence to a minimum.

Figure 4:
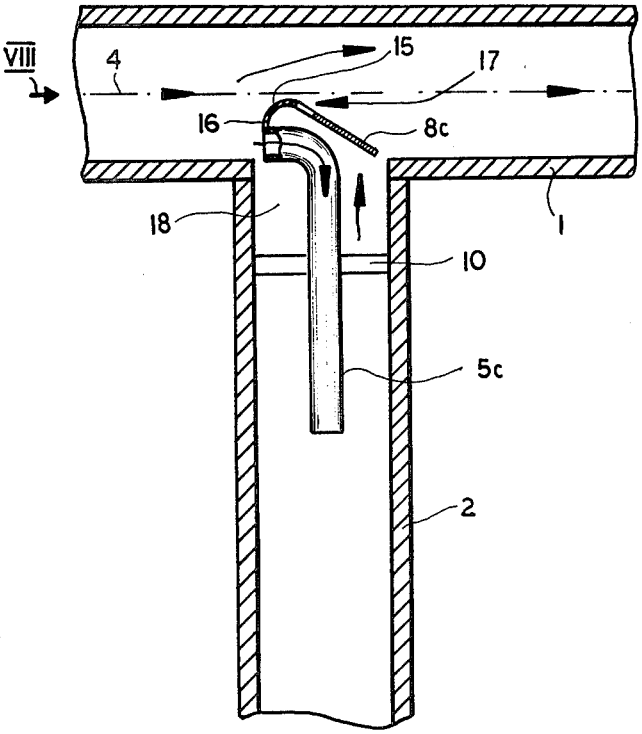

In the arrangement of FIGS. 4 and 8 and L-shaped pipe 5*c* is provided opening at its upstream intake mouth immediately above the lower edge of the tube 1. This tube 5*c* is provided with a plate 8*c* of substantially the same shape and dimensions as the plate 8*a*, but extending downwardly back in the direction 4 and formed with three throughgoing holes 17. This plate 8*c* has a web 15 with a front edge 16 connected to the upper side of the inlet mouth of the tube 5*c*. Thus this structure constitutes an air guide, so that air rising in the space 18 will be sucked out through the holes 17 in a manner that minimizes turbulence in the tube 1. Once again all of the structure is mounted within a vertical projection of the inner wall of the tube 2.

With the system according to the instant invention the turbulence zones normally present at the joint 3 between each of the horizontal tubes 1 and the vertical tubes 2 are largely eliminated. Thus the coolant can flow through these tubes substantially faster to achieve much more efficient cooling.

We claim:

1. A furnace workpiece-support system having at least one horizontal workpiece-support tube through which a fluid coolant is circulated, at least one vertical tube connected at its upper end to said horizontal tube and having a blind lower end, a flow-diversion pipe having an upper intake end opening in an upstream direction into said horizontal tube and a lower end opening downwardly into said vertical tube, said pipe being received with clearance in said vertical tube, whereby said coolant is diverted by said pipe from said horizontal tube, is injected downwardly into said vertical pipe to cool same, and rises vertically in said vertical tube around said pipe to reenter said horizontal tube after cooling said vertical tube, the improvement comprising:

a deflection plate in said horizontal tube generally blocking at least the lower part of the flow cross section thereof, said intake end of said pipe opening at said plate.

2. The improvement defined in claim 1 wherein said plate is planar and is inclined downwardly in said upstream direction.

3. The improvement defined in claim 2 wherein said plate blocks at least one-third of the flow cross section of said horizontal tube.

4. The improvement defined in claim 2 wherein said pipe has a horizontal leg in said horizontal tube, a vertical leg in said vertical tube, and an elbow interconnecting said legs.

5. The improvement defined in claim 4 wherein said horizontal leg has an intake mouth at said plate.

6. The improvement defined in claim 4 wherein said horizontal leg has a relatively large intake mouth opening in said upstream direction and forms at said elbow a relatively small output mouth opening downstream of said plate in a horizontal downstream direction.

7. The improvement defined in claim 4 wherein said vertical tube has struts supporting said vertical leg with all-around clearance in said vertical tube.

8. The improvement defined in claim 7 wherein said plate is carried on said pipe.

9. The improvement defined in claim 1 wherein said plate is generally planar and is inclined upwardly in said upstream direction.

10. The improvement defined in claim 9 wherein said plate has an upstream edge at said intake end of said vertical pipe and a downstream edge spaced therebehind in the downstream direction, and is formed between said edges with at least one throughgoing hole.

* * * * *